US005172562A

United States Patent [19]

Manz et al.

[11] Patent Number: 5,172,562

[45] Date of Patent: Dec. 22, 1992

[54] REFRIGERANT RECOVERY, PURIFICATION AND RECHARGING SYSTEM AND METHOD

[75] Inventors: Kenneth W. Manz, Paulding, Ohio; Charles E. Dull, Fort Wayne, Ind.

[73] Assignee: SPX Corporation, Muskegon, Mich.

[21] Appl. No.: 757,663

[22] Filed: Sep. 10, 1991

Related U.S. Application Data

[63] Continuation-in-part of Ser. No. 556,624, Jul. 20, 1990, abandoned.

[51] Int. Cl.[5] ..... F25B 45/00

[52] U.S. Cl. ..... 62/149; 62/292; 62/77

[58] Field of Search ..... 62/77, 85, 149, 475, 62/474, 195, 292

[56] References Cited

U.S. PATENT DOCUMENTS 4,441,330 4/1984 Lower et al. ..... 62/149
4,470,265 9/1984 Correia ..... 62/77

*Primary Examiner*—John Sollecito
*Attorney, Agent, or Firm*—Barnes, Kisselle, Raisch, Choate, Whittemore & Hulbert

[57] ABSTRACT

In a combined recovery, purification and recharging system, a refrigerant compressor has an inlet coupled to a recovery control valve for connection to a refrigeration system under service from which refrigerant is to be recovered, purified and recharged into the system. The compressor outlet is connected to a first port of a refrigerant storage container. A filter for removing contaminants from refrigerant is coupled to a circulation control valve for selectively circulating refrigerant in a closed path during a purification cycle from a second port of the container through the filter back to the first port of the container. A vacuum pump is coupled to a vacuum control valve for selective connection to the refrigeration system under service during a vacuum cycle for evacuating the system under service to atmosphere. A pressure sensor is connected to the vacuum pump for automatically terminating vacuum pump operation when pressure in the system under service is below a preselected low-pressure threshold. The purification cycle may be initiated either automatically upon initiation of a vacuum cycle, or by an operator independently of the vacuum cycle. A recharging control valve is coupled to the second port of the refrigerant storage container for selectively feeding fresh refrigerant from the storage container to the refrigeration system under service during a recharging cycle.

11 Claims, 2 Drawing Sheets

REFRIGERANT RECOVERY, PURIFICATION AND RECHARGING SYSTEM AND METHOD

This application is a continuation-in-part of application Ser. No. 07/556,624 filed Jul. 20, 1990 now abandoned.

The present invention is directed to devices for recovering refrigerant from refrigeration systems such as air conditioning and heat pump systems, purification of recovered refrigerant for removal of water and other contaminants, storage of used and/or purified refrigerant, and recharging of the refrigeration system using stored and purified refrigerant.

BACKGROUND OF THE INVENTION

Many scientists contend that release of halogen refrigerants into the atmosphere deleteriously affects the ozone layer that surrounds and protects the earth from ultraviolet solar radiation. Recent international discussions and treaties, coupled with related regulations and legislation, have renewed interest in devices for recovery and storage of used refrigerants from refrigeration systems for later purification and reuse or for proper disposal. U.S. Pat. No. 4,261,178, assigned to the assignee hereof, discloses a refrigerant recovery system in which the inlet of a compressor is coupled through an evaporator and through a manual valve to the refrigeration system from which refrigerant is to be recovered. The compressor outlet is connected through a condenser to a refrigerant storage container. The condenser and evaporator are combined in a single assembly through which cooling air is circulated by a fan. Content of the storage container is monitored by a scale on which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration system and automatically terminating operation of the compressor motor.

U.S. Pat. No. 4,441,330, assigned to the assignee hereof, discloses a system for recovery, purification and recharging of refrigerant in a refrigeration system in which a compressor is connected by solenoid valves through a condenser/evaporator unit and an oil separator to a refrigeration system from which refrigerant is to be recovered, and to a storage tank or container for storing recovered refrigerant. A separate liquid pump is controlled by microprocessor-based electronics to extract refrigerant from the storage container, circulate the refrigerant through a filter and purification unit, and then to recharge the refrigeration system from refrigerant in the purification unit. A separate vacuum pump is connected to the refrigeration system by solenoid valves to evacuate the refrigeration system to atmosphere after recovery of refrigerant therefrom during the refrigerant purification operation.

U.S. Pat. No. 4,688,388, assigned to the assignee hereof, discloses apparatus for service and recharge of refrigeration equipment, with particular application to automotive air conditioning equipment. A vacuum pump, and oil and refrigerant charge containers are housed within a portable enclosure and configured for selective connection by electrically operated solenoid valves to refrigeration equipment under service. The refrigerant and oil containers are carried by a scale that provides electrical output signals as a function of weight of refrigerant and oil remaining in the containers. A microprocessor-based controller receives the scale signals and control signals from an operator panel for automatically cycling through vacuum, oil charge and refrigerant charge stages in a programmed mode of operation. The microprocessor-based controller includes facility for operator programming of the vacuum time and oil and refrigerant charge quantities, and for self- or operator-implemented diagnostics. Operating conditions and stages are displayed at all times to the operator.

U.S. Pat. No. 4,805,416, assigned to the assignee hereof, discloses a system for recovering, purifying and recharging refrigerant in a refrigeration system that includes a refrigerant compressor having an inlet connected through a recovery control valve to a refrigeration system from which refrigerant is to be recovered, purified and recharged. The outlet of the compressor is connected to the first port of a refrigerant storage container, and is operated by an electronic controller in a recovery cycle with the recovery control valve open for extracting refrigerant from the refrigeration system and feeding the refrigerant to the storage container. During a purification cycle, refrigerant is circulated from a second port of the refrigerant storage container in a closed path through a circulation control valve and a filter for removing water and other contaminants, and then returned to the first container port. The refrigeration system from which refrigerant has been recovered is evacuated to atmosphere during a vacuum cycle by means of a vacuum pump connected to the system through a vacuum control valve. The vacuum control valve is opened and the vacuum pump is energized during the vacuum cycle for a predetermine time duration set by the control electronics. Following such evacuation, during a recharging cycle, the second control port of the refrigerant storage container is connected through a recharging valve to the refrigeration system for feeding refrigerant from the storage container to the refrigeration system, and thereby recharging the refrigeration system for normal use.

OBJECTS AND SUMMARY OF THE INVENTION

A general object of the present invention is to provide a combined refrigerant recovery and recharging system in which, following termination of the recovery cycle, the system is automatically operated in a vacuum cycle so as to evacuate the system under service to a preselected low-pressure threshold preparatory to recharging the system under service with fresh refrigerant. Another and more specific object of the present invention is to provide a system of a described character in which pressure in a refrigeration system under service is monitored following the vacuum cycle, and in which the evacuation cycle is automatically reinitiated in the event that system pressure increases. Yet another object of the present invention is to provide a combined recovery, purification and recharging system in which the purification cycle is automatically initiated facility for manual initiation of a purification cycle independently of the vacuum cycle.

A system for recovering and recharging refrigerant in refrigeration equipment under service in accordance with the present invention includes a first refrigerant pump having an inlet connected by a recovery control valve to a system inlet for connection to the equipment from which refrigerant is to be recovered and into which refrigerant is to be recharged. The outlet of the first refrigerant pump is connected to a refrigerant storage container. A vacuum pump is coupled to a vacuum control valve for selectively connecting the vacuum pump to the refrigeration system under service. A recharging control valve selectively connects the refrigeration equipment under service to a source of fresh refrigerant. An electronic controller includes a pressure sensor connected to the vacuum pump for sensing pressure in the refrigeration system under service during operation of the vacuum pump. During operation of the vacuum pump, when the vacuum control valve is open in a vacuum cycle, the electronic controller monitors output of the pressure sensor and automatically terminates operation of the vacuum pump when pressure at the sensor reaches a preselected low-pressure threshold.

Preferably, the pressure sensor is connected between the vacuum control valve and the pump, and the vacuum control valve is automatically closed by the electronic controller during a refrigerant recovery cycle to protect the pressure sensor from pressure of refrigerant during the recovery cycle. The pressure sensor has a sensitivity range well below one atmosphere pressure—e.g., in the 1,000 to 5,000 micrometers of mercury range. To protect this sensor from damage at high system inlet pressure, a vacuum control sensor is connected between the first vacuum control valve and the system inlet, and inhibits operation of the first vacuum control valve when inlet pressure is greater than a preselected vacuum cycle threshold—e.g., 40 psi. In the preferred embodiment of the invention, the electronic controller continues to monitor output of the pressure sensor following termination of operation of the vacuum pump for reinitiation operation of the vacuum pump if pressure at the sensor rises above a second preselected threshold greater than the low-pressure threshold. Most preferably, a second vacuum control valve is connected between the pressure sensor and the vacuum pump for isolating the pressure sensor from any leakage at the vacuum pump following termination of vacuum pump operation.

In a combined recovery, purification and recharging system in accordance with a particularly preferred implementation of the invention, a refrigerant compressor has an inlet coupled to a recovery control valve for connection to a refrigeration system under service from which refrigerant is to be recovered, purified and recharged into the system. The compressor outlet is connected to a first port of a refrigerant storage container. A filter for removing contaminants from refrigerant is coupled to a circulation control valve for selectively circulating refrigerant in a closed path during a purification cycle from a second port of the container through the filter back to the first port of the container. A vacuum pump is coupled to a vacuum control valve for selective connection to the refrigeration system under service during a vacuum cycle for evacuating the system under service to atmosphere. A pressure sensor is connected to the vacuum pump for automatically terminating vacuum pump operation when pressure in the system under service is below a preselected low-pressure threshold. The purification cycle may be initiated either automatically upon initiation of a vacuum cycle, or by an operator independently of the vacuum cycle. A recharging control valve is coupled to the second port of the refrigerant storage container for selectively feeding fresh refrigerant from the storage container to the refrigeration system under service during a recharging cycle.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosure of U.S. Pat. No. 4,805,416 is incorporated herein by reference.

Figure 1:
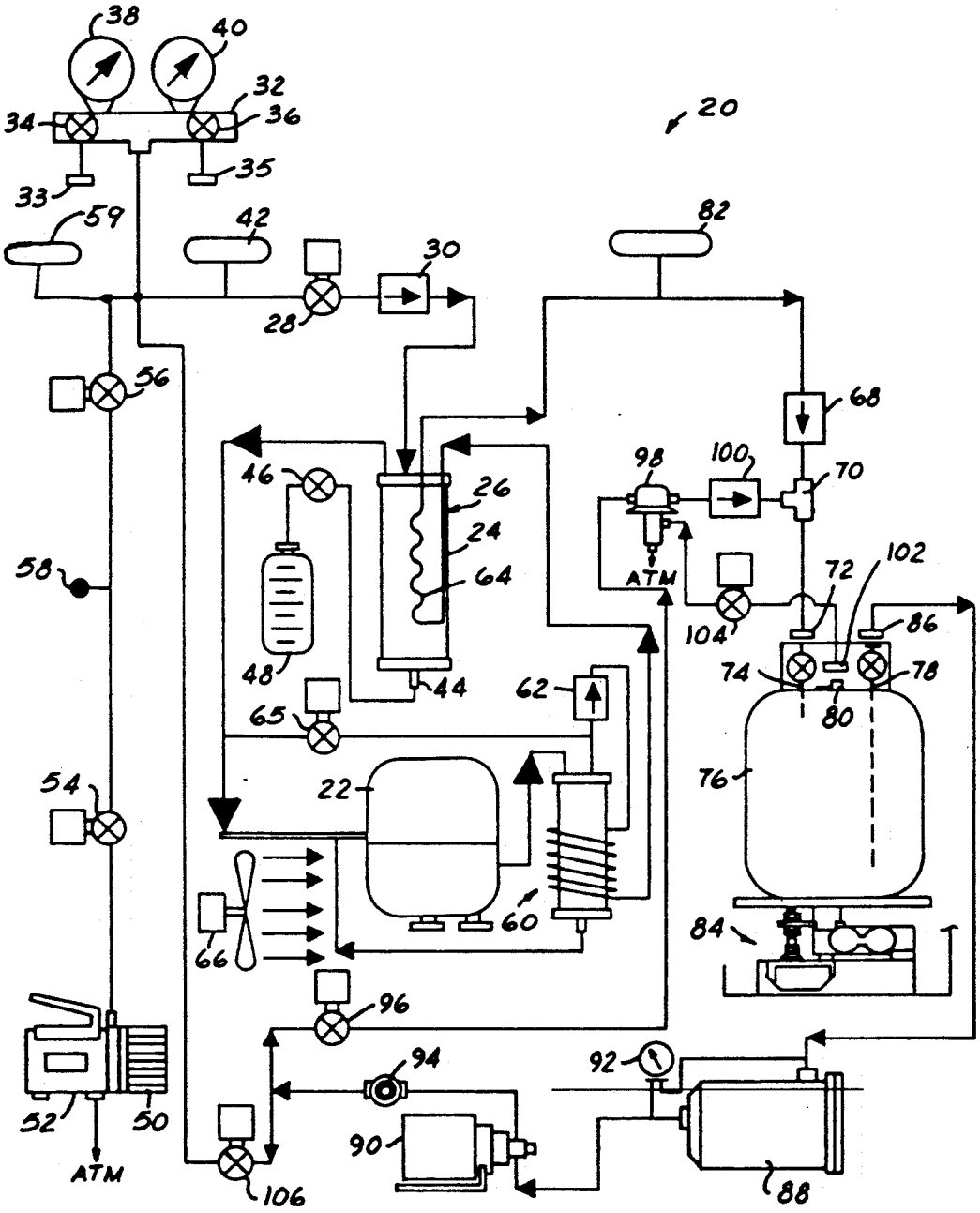
FIG. 1 is a schematic diagram of a refrigerant recovery, purification and recharging system in accordance with one presently preferred embodiment of the invention.

FIG. 1 illustrates a presently preferred embodiment of a refrigerant recovery, purification and recharging system 20 in accordance with the invention as comprising a compressor 22 having an inlet that is coupled to an input manifold 32 through the evaporator section 24 of a combined heat-exchange/oil-separation unit 26, a recovery control solenoid valve 28 and a check valve 30. Manifold 32 includes quick disconnects 33,35 for connection to the high-pressure and low-pressure sides of refrigeration equipment under service from which refrigerant is to be recovered. Manifold 32 also includes the usual manual valves 34,36 and pressure gauges 38,40. A pressure switch 42 is connected between solenoid valve 28 and manifold 32, and is responsive to a predetermined low pressure to the compressor inlet from the refrigeration system under service to indicate removal or recovery of refrigerant therefrom. An oil drain 44 at the bottom of unit 26 is connected through a manual valve 46 to a container or catch bottle 48. A vacuum pump 50 with associated pump-drive motor 52 is connected t manifold 32 serially through first and second vacuum control solenoid valves 54,56 for selectively evacuating to atmosphere the refrigeration system coupled to manifold 32. A pressure sensor 58 is positioned between control valves 54,56, and provides an electrical output signal as a function of pressure in the refrigerant line connected therebetween. A vacuum control switch 59 is connected between valve 56 and inlet manifold 32 for inhibiting operation of valve 56 at high inlet pressure, and thereby preventing damage to sensor 58.

The outlet of compressor 22 is connected through a compressor oil separator 60 and a check valve 62 to the condenser portion 64 of heat-exchange/oil-separation unit 26. The oil drain of compressor oil separator 60 is connected to the compressor inlet for returning lubricant thereto. An electrically operated solenoid valve 65 is connected across compressor 22 between the compressor inlet and the oil separator outlet for easing starting of the compressor. A fan 66 blows cooling air over compressor 22 and oil separator 60. Oil separator 60 is disclosed in greater detail in copending U.S. application Ser. No. 07/468,068, filed Jan. 22, 1990 and assigned to the assignee hereof. The disclosure of such copending application is incorporated herein for purposes of background. The outlet of condenser section 64 is fed through a check valve 68, a T-coupling 70 and a quick-disconnect coupling 72 to the vapor port 74 of a refrigerant storage container 76. Container 76 also includes a liquid port 78 and a purge port 80. A suitable container 76 is marketed by Manchester Tank Company under the trademark ULTRALINE. A pressure switch 82 is connected between check valve 68 and condenser section 64, and is responsive to vapor pressure within container 76 to indicate an excessive vapor pressure of predetermined level therewithin. Container 76 is mounted on a scale 84, which provides an output signal to the system control electronics (FIG. 2) indicative to weight of refrigeration within container 76.

Container liquid port 78 is connected through a quick-disconnect coupling 86 and through a replaceable core filter/dryer unit 88 to the inlet of a liquid pump 90. A differential pressure gauge 92 is connected across filter,/dryer unit 88 to indicate pressure drop across unit 88 above a preselected threshold, which may be marked on the pressure indicator, and thereby advise an operator to replace the filter/dryer core of unit 88. The outlet of pump 90 is connected through a moisture indicator 94 and an electrically operated purification control solenoid valve 96 to an air purge valve 98. The outlet of valve 98 is connected through a check valve 100 to T-coupling 70. Valve 98 also receives an input from container purge port 80 through a quick-disconnect coupling 102 and a solenoid valve 104. Air purge valve 98 functions to vent air from within storage container 76 whenever container air pressure exceeds refrigerant saturation pressure by a preselected threshold differential, and is described in greater detail in copending U.S. application Ser. No. 07/405,236, filed Sept. 11, 1989, assigned to the assignee hereof and incorporated herein by reference for purposes of background. An electrically operated recharge control solenoid valve 106 is connected between the junction of moisture indicator 94 and solenoid valve 96, and the junction of solenoid valve 56 and pressure switch 42.

Figure 2:
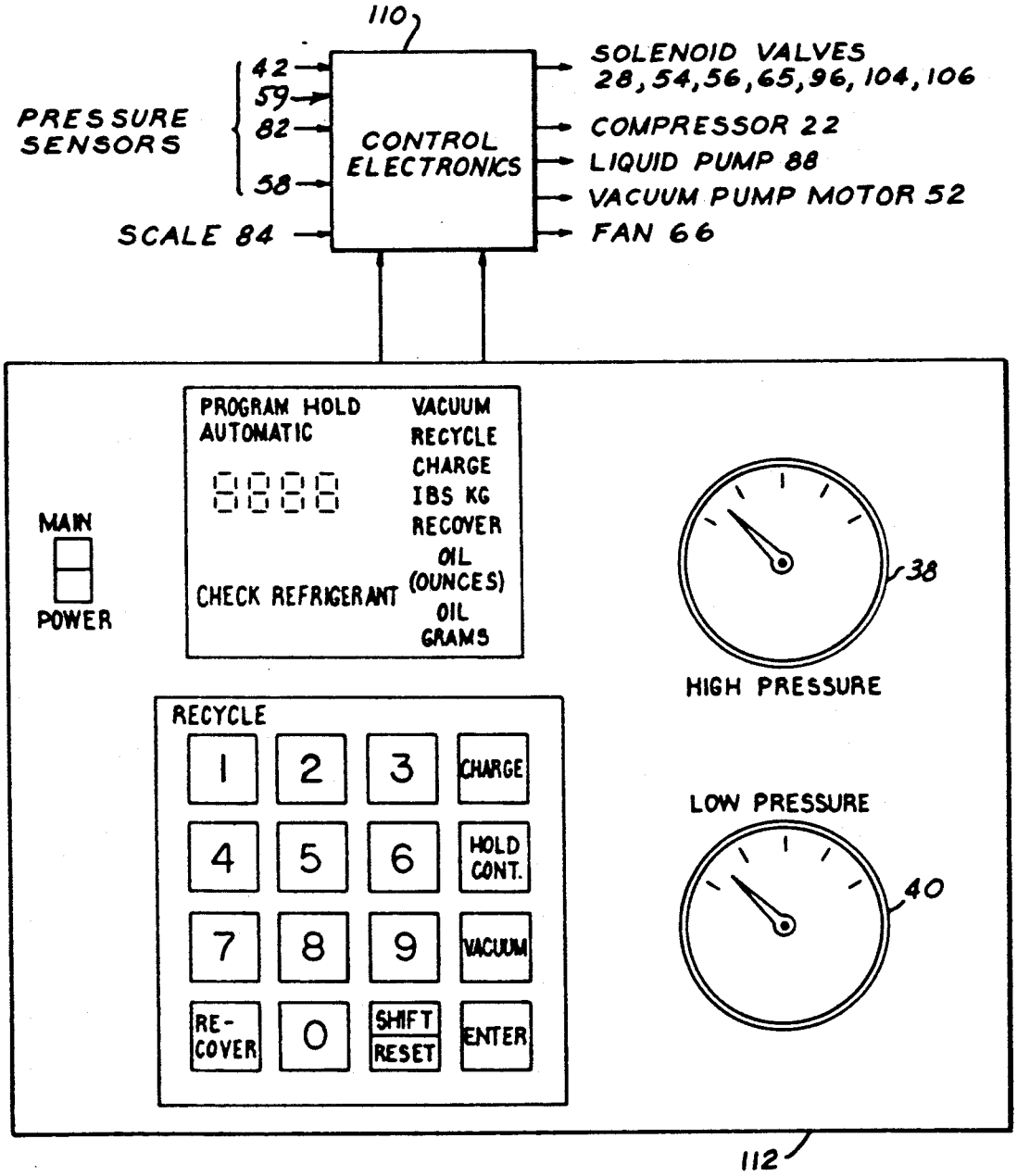
FIG. 2 is a block diagram of control electronics for use in conjunction with the system illustrated in FIG. 1.

FIG. 2 illustrates control electronics 110, which preferably is microprocessor-based, for operating the combined refrigerant recovery, purification and recharging system 20 illustrated in FIG. 1. Control electronics 110 is connected to an operator switch/indicator panel 112 for receiving operator control inputs. Control electronics 110 also receives inputs from pressure switches 42,59,82, pressure sensor 58 and container scale 84, and provides appropriate control outputs to solenoid valves 28,54,56,65,96, 104 and 106, compressor 22, liquid pump 88, vacuum pump motor 52 and fan 66. Valve 65 is normally open, and is closed by application of electrical power thereto. All remaining solenoid valves are normally closed, and are opened by application of electrical power thereto.

In operation, manifold 32 is first connected to refrigeration equipment—e.g., an air conditioning system or heat pump system—from which refrigerant is to be recovered, purified and recharged into the system. Container 76 is placed on scale 84 and quick-disconnects 72.86, 102 are connected thereto. Manual valves at the container ports are opened, manual valve 46 is closed, solenoid valve 65 is open and all remaining solenoid valves are normally closed. Upon initiation of a refrigerant recovery operation by the operator, control electronics 110 (FIG. 2) opens solenoid valve 28 and energizes compressor 22. After a predetermined time delay sufficient to allow the compressor to start, solenoid valve 65 is closed. During the refrigerant recovery cycle or mode of operation, refrigerant is drawn from the equipment under service to the compressor inlet through valve 28, and check valve 30 and evaporator section 24 of combined unit 26. Recovered refrigerant is fed from the compressor outlet through condenser section 64 of combined unit 26 where heat is exchanged with input refrigerant to evaporate the latter and condense the former, and thence through check valve 68 to vapor port 74 of container 76. When substantially all refrigerant has been withdrawn from the refrigeration system to which manifold 32 is connected, recovery pressure switch 42 indicates a low system pressure condition to the control electronics, which then closes valve 28, de-energizes or terminates operation of compressor 22, and opens valve 65 to equalize pressure across the compressor preparatory to the next recovery operation.

Before recharging the refrigeration system under service with fresh refrigerant, the system refrigerant lines must be evacuated. Upon initiation of a vacuum cycle or mode of operation, valves 54,56 are opened, motor 52 is energized to drive pump 50 and evacuate the system under service to atmosphere. During the vacuum mode, control electronics 110 monitors the output of pressure sensor 58. When the sensor output indicates that pressure within the refrigeration system under service has declined below a preselected low-pressure threshold such as 1,000 micrometers of mercury, pump motor 52 is de-energized and solenoid valve 54 is closed. With valve 56 still open, control electronics 110 continues to monitor the output of pressure sensor 58 for a preselected time duration. If the pressure sensor output indicates that system pressure has increased above a second higher threshold, such as 1,500 micrometers of mercury, the operator is alerted through the control panel to check for system leaks. On the other hand, if system pressure does not rise above such higher threshold during such time duration, the vacuum cycle is automatically terminated and valve 56 is closed by control electronics 110.

By way of example, recovery pressure switch 42 may terminate a recovery cycle when inlet pressure drops below a preset recovery threshold of 17 in. Hg vacuum (6.3 psi). Operation then pauses for some preset period of time, such as two to five minutes specified by SAE standard J1989. If during this time inlet pressure rises to a higher present recovery threshold—e.g., 0 to 5 in. Hg (12.2 to 14.7 psi)—the recovery cycle is restarted. After the delay period (e.g., two to five minutes), the inlet pressure may rise above its recovery threshold due to outgassing of refrigerant from hose materials or lubricant, for example. It is also typical that the refrigerant circuit of the equipment under service may be opened for repairs. Thus, it is to be expected that pressure of the inlet will be above the upper threshold of switch 42 when it is desired to begin a vacuum cycle. Switch 59 functions to inhibit operation of valve 56, and to prevent initiation of a vacuum cycle, if inlet pressure is sufficiently high to damage sensor 58. For example, switch 59 may be set to inhibit operation of valve 56 if inlet pressure is above 25 psig. (40 psia). This limit is determined to allow enhanced accuracy of sensor 58 in percent of full scale at low vacuum levels such as the 1,000 to 5,000 micrometers of memory range where leak detection occurs.

It will thus be appreciated that valve 56 and switch 59 operate to isolate pressure sensor 58 from the substantially higher pressures that occur at manifold 32 during the recovery (and recharging) modes of operation. It has been found that pressure sensors capable of withstanding system pressures at the upper end of the normal operating range, such as 250 psi during system recharging, do not possess desired accuracy at the extreme low end of the operating range for detecting system evacuation. However, valve 56 functions to limit the operating range of pressure sensor 58 to a high pressure equal to system pressure following the recovery cycle, normally about seventeen inches of mercury, to a low pressure of about 1,000 micrometers. Within this range, accuracy and precision of about 0.04% is practical. Solenoid valve 54 functions when closed to isolate pressure sensor 58 and the system under service from any leakage at vacuum pump 50.

Simultaneously with initiation of a vacuum cycle, control electronics 110 initiates a purification cycle or mode of operation by opening purification control valve 96 and air purge control valve 104, and applying power to liquid refrigerant pump 90. Thus, liquid refrigerant is circulated through filter/dryer 88 for removal of water and other contaminants. Upon termination of a vacuum cycle, the operator may observe moisture indicator 94 to see whether the refrigerant is at desired purity. If so, the operator may then proceed to a recharging mode of operation. If not, the operator may initiate a purification cycle independently of the vacuum cycle to continue circulation of refrigerant through filter/dryer 88 until sufficient moisture has been withdrawn from the refrigerant to yield the desired indication at indicator 94. Thus, considerable time is saved by automatically initiating purification during the vacuum cycle, while maintaining flexibility for manual initiation of a purification cycle independently of the vacuum pump.

After the system under service has been evacuated and refrigerant is at desired purity, the operator may initiate a recharging mode of operation in which control electronics 110 (FIG. 2) energizes liquid pump 90 and opens valve 106. Thus, the refrigeration system to which manifold 32 is connected is recharged by liquid refrigerant fed under pressure thereto by pump 90. Following transfer of the desired quantity of refrigerant to the system under service, the recharging mode of operation is terminated, either automatically by control electronics 110 responsive to weight of refrigerant transferred sensed by scale 84, or manually by the system operator.

System 10 illustrated in the drawings is susceptible to a number of modifications and variations, many of which are illustrated in the various patents and applications discussed hereinabove. For example, U.S. Pat. No. 4,805,416 illustrates a number of recovery, purification and recharging systems in connection with which the present invention may be employed. Recharging of the refrigeration system may be accomplished by other than a liquid refrigerant pump 90, such as by latent heat of refrigerant within container 76, or by compressor 22 in association with suitable flow control valves.

We claim:

1. A system for recovery and recharging refrigerant in refrigeration equipment that comprises:

means forming a system inlet for connection to equipment under service, first refrigerant pump means having an inlet and an outlet, means including a recovery control valve for connecting said inlet of said first refrigerant pump means to said system inlet, and a recovery control sensor connected between said recovery control valve and said system inlet for terminating a recovery cycle when pressure at said system inlet drops below a recovery threshold value which indicates that substantially all refrigerant has been recovered, means connected to said outlet of said first pump means for storing recovered refrigerant, means for evacuating the refrigeration equipment including a vacuum pump, a first vacuum control valve for selectively connecting said vacuum pump to said system inlet, and a vacuum control sensor connected between said first vacuum control valve and said system inlet and having a vacuum cycle threshold above one atmosphere absolute pressure for inhibiting opening of said first vacuum control valve when pressure at said system inlet is greater than said vacuum cycle threshold, and control means including a pressure sensor separate from said recovery control sensor and said vacuum control sensor connected between said vacuum pump and said first vacuum control valve for sensing pressure in the refrigeration equipment during operation of said evacuating means, means coupled to said vacuum valve and to said vacuum pump, and responsive to an operator, for selectively opening said first vacuum control valve and operating said vacuum pump during a vacuum cycle, and means responsive to said pressure sensor for terminating operation of said vacuum pump when pressure at said sensor reaches a preselected low-pressure threshold, said pressure sensor having a pressure sensitivity range below one atmosphere absolute and being protected against inadvertent opening of said first vacuum control valve by said vacuum control sensor.

2. The system set forth in claim 1 wherein said control means further includes means responsive to said sensor following termination of operation of said vacuum pump when pressure at said sensor rises above a second preselected threshold greater than said low-pressure threshold for indicating a possible system leak condition to an operator.

3. The system set forth in claim 2 wherein said evacuating means further includes a second vacuum control valve connected between said pressure sensor and said vacuum pump, and means for closing said second vacuum control valve upon termination of operation of said vacuum pump to isolate said sensor from any leakage at said pump.

4. The system set forth in claim 3 wherein said control means further includes means responsive to said sensor for closing said first vacuum control valve and terminating said vacuum cycle when pressure at said sensor remains below said second preselected threshold for a preselected time duration.

5. The system set forth in claim 1 wherein said refrigerant-storing means and said refrigerant source together comprise a refrigerant storage container having first and second ports; wherein said system further comprises means including second pump means, filter means for removing contaminants from refrigerant passing therethrough, and a purification control valve connected in series with said second pump means and said filter between said first and second ports; and wherein said control means further includes means responsive to an operator for opening said purification control valve and operating said second pump means for selectively circulating refrigerant in a purification cycle from said second port through said filter to said first port.

6. The system set forth in claim 5 wherein said control means includes means responsive to initiation of a vacuum cycle for automatically initiating a purification cycle.

7. The system set forth in claim 6 wherein said control means further comprises means responsive to an operator for initiating a purification cycle independently of said evacuating means.

8. The system set forth in claim 5 wherein said first and second pump means comprise separate refrigerant pump means.

9. The system set forth in claim 5 wherein said first pump means comprise a refrigerant compressor, and wherein said second pump means comprise a liquid refrigerant pump.

10. The system set forth in claim 9 wherein said recharging means includes said liquid refrigerant pump.

11. The system set forth in claim 5 in which all of said valves comprise electronic valves operated by said control means.

* * * * *